United States Patent [19]

Olson

[11] Patent Number: 4,481,932

[45] Date of Patent: Nov. 13, 1984

[54] DOUBLES TARGET TRAP

[76] Inventor: Scott M. Olson, 108 Lakeview Cir., Buffalo, Minn. 55313

[21] Appl. No.: 431,618

[22] Filed: Sep. 30, 1982

[51] Int. Cl.[3] ..... F41B 7/00

[52] U.S. Cl. ..... 124/8; 124/43

[58] Field of Search ..... 124/7, 8, 9, 36, 42, 124/43, 34

[56] References Cited

U.S. PATENT DOCUMENTS

| | | | |
|---|---|---|---|
| 822,741 | 6/1906 | Ketcham . | |
| 963,347 | 7/1910 | Winans | 124/36 X |
| 1,445,371 | 2/1923 | Vickery | 124/6 |
| 1,495,349 | 5/1924 | Olin | 124/8 |
| 2,078,166 | 4/1937 | Schwerin | 124/6 |
| 2,193,266 | 3/1940 | Betts | 124/8 |
| 3,093,127 | 6/1963 | Starr | 124/8 |
| 3,179,101 | 4/1965 | Luebkeman | 124/8 |
| 3,368,542 | 2/1968 | Dale | 124/8 |
| 3,552,900 | 1/1971 | Newill | 124/6 |
| 3,601,112 | 8/1971 | Dale | 124/8 |

*Primary Examiner*—Richard J. Apley
*Assistant Examiner*—William R. Browne
*Attorney, Agent, or Firm*—Schroeder Siegfried Vidas & Arrett

[57] ABSTRACT

A target trap for multiple disk targets having a base, an elevational arm, a lower target throwing arm rotatably mounted to a shaft on the elevational arm, and a power device to rotate the lower target throwing arm. An upper target throwing arm is hingedly mounted by its trailing edge to the trailing edge of the lower arm and a linkage device varies the separation between the leading edges of the upper and lower arms causing targets to be thrown at varying speeds and angles.

12 Claims, 3 Drawing Figures

DOUBLES TARGET TRAP

DESCRIPTION

1. Field of the Invention

This invention relates to a device for throwing disk targets, known as clay pigeons.

2. Description of the Prior Art

Trap shooting launchers or target traps are well known and are used to throw frangible objects, such as clay pigeons, into the air for target practice. The targets typically rest on an elongated target throwing arm with the trailing edge formed with a channel shaped rail. A shaft is attached laterally to the arm at one end. Power is supplied to rotate the shaft which, in turn, causes the arm to revolve. Centrifugal forces cause the trap to be thrown from the arm. Power is usually supplied by spring loading the arm or by rotating the shaft with an electric motor. Targets also develop a spin as they roll from the arm which improves their flight performances.

As trapshooters become more adept, the challenge of shooting a single target diminishes. Additional targets have been placed on the single arm, and in some cases a second arm has supplied the second target. However, the targets will still have basically the same flight pattern.

In U.S. Pat. No. 3,179,101, issued to Luebkeman, a target trap is disclosed with two target throwing arms attached to a single shaft. One arm can be adjustably moved about the shaft, causing a lateral angle between the launching arms. When the arms are rotated, the targets are released at divergent lateral angles.

An object of the present invention is to provide a device which launches one or more targets which can be thrown in varying flight patterns to increase the difficulty in trap shooting.

It is an object of the present invention to provide a device that will release traps to the right, to the center or left. A further object of the present invention is to provide a device for varying elevations, varying speeds and creating trajectories which curve upward or downward at either right, center or left positions.

SUMMARY OF THE INVENTION

The present invention provides a target trap having two throwing arms. The lower arm is attached to a shaft lateral to the arm. The shaft is attached to the base such that the shaft and lower arm can rotate freely.

Power is supplied to the shaft and lower arm by means of a contractile spring or electric motor to supply the necessary rotation.

An upper arm is attached to the lower target throwing arm along the trailing edges of the arms. The attachment is by a hinge or such means as will allow the plane of the upper arm to vary with respect to the lower arm from the trailing to leading edge. An adjustible link means on the outside or leading edge of the arms is employed to hold the angles of the planes of the arms formed in the position desired.

With the links set, such that the plane of the upper target throwing arm is parallel to the lower arm, traps placed on each arm will be thrown in substantially similar flight paths. Moving one trap towards the outer end of an arm will cause that trap to move more slowly and be released first and towards the right in arms that rotate and release counterclockwise. The elevational angle of release will be the same for both traps, regardless of the lateral path divergence.

When the link is adjusted such that the outer edge of the upper target throwing arm is angled upward from the hinge, the trap placed on the upper arm will have a steeper elevational flight path than a target from the lower arm. Also, the angle of the target, as compared to the vector of the force supplied by the spring, causes the target to luff upwards in a curved pattern.

Adjusting the link such that the hinge closes slightly and the upper arm dips downward towards the lower arm causes the trap from the upper arm to have a lower flight path than the lower trap. The effect can be varied such that the two traps coming from the upper and lower arms, respectively, can actually cross flight paths. The angle of the trap, as compared to the force vector from the spring, also causes the trap to curve and decreases its velocity relative to the target from the lower arm.

The device of the invention thus provides an almost infinite degree of variability for trap shooters. Either arm can be used with either one or two traps. A novice may use the single trap from the lower arm with the predictable angles developed. An intermediate shooter may use only the top arm, but adjusted through the hinging means, such that the trap trajectory may be very steep or shallow. The expert may use two traps on the lower arm, separated by several inches, such that the traps come off at divergent lateral angles. Two traps, separated by several inches on the upper arm with the upper arm angled upward or downward, would result in four targets coming off the device. The traps would have lateral separation, vertical separation, speed differences and differing deacceleration characteristics.

BRIEF DESCRIPTION OF THE DRAWINGS

The detailed description of the invention, including a preferred embodiment, is hereinafter described with specific reference being made to the drawings in which.

DETAILED DESCRIPTION OF THE INVENTION

Figure 1:
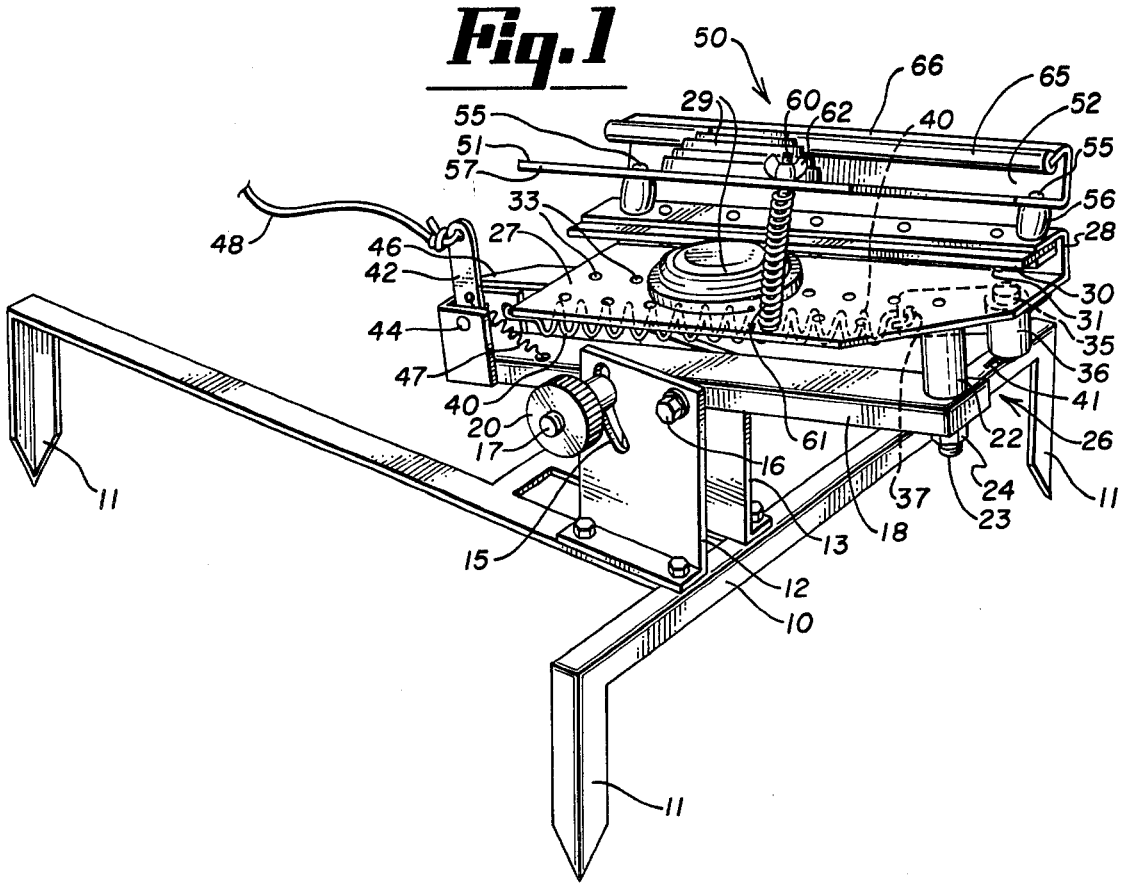
FIG. 1 is a perspective view of the trap in the position with the two throwing arms adjusted to a parallel position and cocked.
Figure 2:
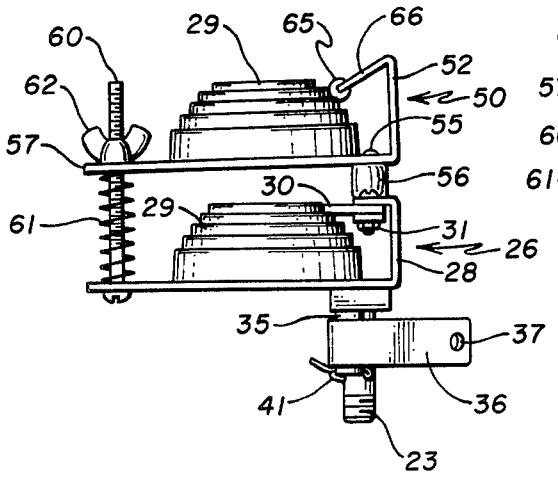
FIG. 2 is an end view along lines 2—2 of the two arms in the parallel position as shown in FIG. 1.
Figure 3:
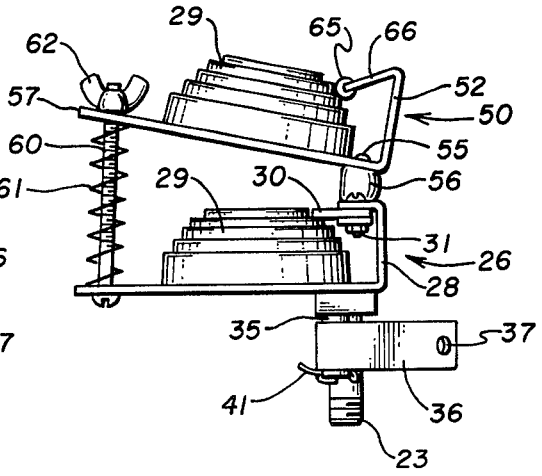
FIG. 3 is an end view of the two arms adjusted such that the leading edge of the upper arm is raised from a parallel relationship in the lower arm.

The trap provided by the present invention includes a tripod base 10 having legs 11 which are adapted to be firmly anchored in the ground. Two vertically extending spaced apart and parallel sheet metal frame members 12 and 13 are mounted on top of the tripod base 10. These frame members have a pair of aligned slots 15 extending therethrough and a large bolt means 16 extending through the plates adjacent the upper front corner.

Elevation arm 18 is pivotally mounted on bolt 16 intermediate the length of the arm, and another bolt means 17 extends through the arm rearwardly of bolt 16 and also extends through the upper slot 15. Large thumb nut or adjusting knob 20 is threadably engaged on the end of bolt 17 and can be tightened so as to secure elevation arm 18 at any angle of inclination to thereby vary the angle at which the clay pigeon is launched.

Tubular pivot shaft housing 22 is rigidly secured to the forward end of the elevation arm and pivot shaft 23 extends through housing 22 and is held in place by nut 24 threaded on the lower end of the shaft. The upper end of pivot shaft 23 is rigidly secured to the forward end of lower throwing arm 26 to thereby permit the throwing arm to swing about shaft 23.

Lower throwing arm 26 is formed having a flat target supporting portion 27 formed with an integral channel shaped rail 28 along its trailing edge. Rubber strip 30 is mounted in the rail by screws 31, the leading edge thereof projecting from the rail for engagement with a target 29 that is to be supported upon portion 27. The longitudinal axis of lower throwing arm 26 extends centrally along rail 28 and said axis projects laterally of the axis of shaft 23.

Lower throwing arm 26 is preferably formed from an aluminum stamping so as to be lightweight and is formed with perforations 33 to decrease air resistance and to make the arm lightweight. Arm 26 may be formed of other materials, such as plastic, and the channel shaped rail 28 may be formed separately, rather than integrally with flat target supporting portion 27.

Extending downwardly and rigidly attached to the underside of the forward end of lower throwing arm 26 is a swivel yoke shaft 35 on which is swingably mounted swivel yoke 36. The swivel yoke 36 has a rear end portion having an aperture 37 in which one end of large tension spring 40 is connected. The lower end of the yoke shaft 35 has a cotter key 41 fixed therein for holding swivel yoke 36 captive on shaft 35.

The other end of large tension spring 40 is connected to the rear end of elevation arm 18 with any suitable means for adjusting the spring tension as is known in the art.

Lower throwing arm 26 is releasably held in spring-loaded position by lever 42 pivoted on elevation arm 18 at pivot point 44 and biased for a releasable engagement behind a trigger catch 46 on the lower arm remote from the pivot mounting. A contractile spring 47 engages the lever at one end and at its other end to elevation arm 18. Release of the spring-loaded arm with the target thereon is accomplished by pulling cord 48 connected to the upper end of lever 42, whereupon the arm will swing around the shaft and launch the target therefrom. A suitable base unit is available from Hoppes, Division of Penguin Industries of Coatesville, Pa.

An upper target throwing arm 50 formed with a flat target-supporting portion 51 and along its trailing edge an integral channel-shaped rail 52 is hingedly mounted to lower throwing arm 26 with the lower rail 28 hinged to upper rail 52.

The hinging action along the trailing edges of the arms can be accomplished by a hinge means, such as a piano hinge, a strip of rubber loosely bolted between the two throwing arms along the rails 28 and 52, or preferably by means of a bolt connecting the rails at both ends of the arms with a rubber doughnut-shaped spacer 56 separating the arms with each bolt 55 passing therethrough.

The hinging action of the two arms is accomplished by means of moving the leading edge 57 of the upper target throwing arm 50 up or down relative to the plane of lower throwing arm 26. The rubber doughnut-shaped spacers 56 deform, allowing movement of upper target throwing arm 50 without bending the arm material.

Adjustment of the planes formed by lower throwing arm 26 relative to upper target throwing arm 50 is accomplished by link means 58 which is connected to both lower and upper arms and can decrease or increase the gap between the arms at their leading edges.

A preferred link means 58 employs bolt 60 extending through flat target-supporting portions 27 and 51. Coil spring 61 is wrapped around bolt 60 in between the two flat target-supporting portions of the arms. Wing nut 62 attached to bolt 60 may then be tightened to pull the leading edge of the upper arm downward towards the lower arm. Loosening the wing nut, in turn, causes spring 61 to push the leading edge 57 of the upper arm upward.

The entire upper target throwing arm 50 can be tilted upward or downward from a parallel position, relative to the fixed plane of lower throwing arm 26. Preferably, the upper arm is tilted up or down from its hinge point thirty degrees or less. Such angles give good target trajectories with minimum target breakage.

Upper target throwing arm 50 preferably is formed with its integral channel-shaped 52 having a rubber strip 65 formed along upper flange portion 66 to assist in positioning and guiding the target during launching. Upper target throwing arm 50 is also preferably made of stamped aluminum formed with perforations 33 to decrease air resistance and to lower the weight. Any other materials which are light in weight such as plastics or metals may be utilized.

In operation, the operator cocks the device by pulling on the arms until trigger catch 46 is caught on lever 42. Large tension spring 40 is thus cocked and, upon cord 48 being pulled, lever 42 releases trigger catch 46 causing the arms to rapidly swing out in a counterclockwise motion until the targets are thrown by centrifugal force.

The novel design of the upper target throwing arm 50 and hinging action combined with a base, elevational arm and lower targer arms of prior art devices provides the operator with a greater array of possible trajectories.

When link means 58 is adjusted so as to raise the leading edge 57 of upper throwing arm 50, the clay pigeon will leave the upper arm at an angle higher to the direction of force formed by the spring. The clay pigeon would then tend to luff with its bottom against the air causing it to curve upward and to slow down much more rapidly than if the arms were in a parallel position. By moving the pigeon along the length of the upper arm, this steep, upward and curving angle can be developed to the right, center or left position.

Likewise, tightening wing nut 62 would cause the arms' leading edge 57 to draw closer to the lower arms' leading edge. A clay pigeon propelled from the upper arm in this position would tend to decrease in velocity and curve downward more rapidly than a pigeon released from a parallel position. It is possible to adjust the position of the clay pigeons on the arms along with the planar adjustment created by the hinges of the arms, such that the trajectories of the lower and upper pigeon actually cross in mid-air.

Generally, any number of pigeons could be placed on the two arms. The upper arm, with its unique angling feature, can be used for single or double placement of clay pigeons or only the lower arm can be used. For a greater degree of difficulty, two clay pigeons may be placed on the lower target arm and two placed on the upper target arm, resulting in four targets spaced laterally, vertically and with vastly velocities due to the increased deacceleration of the pigeons when the upper arm is tilted either upwards or downwards in relation to the lower arm.

Although the invention has been described in reference to trap launchers with power supplied by a heavy contractile spring, devices powered by electric motors or the like may also be utilized.

What is claimed is:

1. A trap for throwing targets comprising:

a frame;

an upstanding shaft supported for rotation upon said frame;

a first target throwing arm mounted adjacent one end on said shaft, with its longitudinal axis projecting laterally of said shaft axis, said arm defining a leading and trailing edge;

power means on said frame and operably joined to said first throwing arm to swing the arm and launch targets therefrom;

a second target throwing arm positioned generally above the first throwing arm and having a leading and trailing edge, hinge means for hingedly connecting the two arms, said trailing edge of one of said arms being hingedly mounted by said hinge means to the other of said arm along its trailing edge and at least two points adjacent opposite ends of said arms, said arms having target support portions, the hinge means permitting the angle formed by the planes of said target support portions to be varied, and means to vary the angle between said planes of the target support portions, whereby the vertical component of trajectory of at least one projectile may be varied.

2. The trap of claim 1 wherein said target throwing arms include channel shaped rails integrally formed along said trailing edges to support and guide disk targets.

3. The trap of claim 2 wherein said first target throwing arm is hingedly attached to said second target throwing arm by means of compressible rubber spacers bolted between said channel shaped rails.

4. The trap of claim 2 wherein said leading edge of said second target throwing arm may be raised up to 30 degrees and lowered up to 30 degrees from a parallel relationship to the first arm.

5. In a trap for throwing targets comprising:

a frame;

an upstanding shaft supported upon said frame;

a first target throwing arm mounted at one end on said shaft with the longitudinal axis projecting laterally of said shaft axis;

power means on said frame and connected to said first arm to swing the arm and launch targets therefrom, the improvement comprising:

a second target throwing arm positioned generally above the first throwing arm and being hingedly mounted to said first arm along its longitudinal axis with a hinge joint adjacent each end of said arms, each of said arms having target support portions, the hinge joint permitting the angle formed by the planes of said target throwing arms to be varied; and means to vary the angle between said target throwing arms whereby the vertical component of trajectory of at least one projectile may be varied.

6. A target throwing arm assembly adapted to be joined to a conventional target throwing base, said conventional target throwing base including at least one arm with a channel shaped rail at the trailing edge thereof, the assembly comprising:

a flat target supporting plate defining trailing and leading edges;

a channel shaped rail formed along said trailing edge of said plate to guide targets;

hinge means including pivots joined to said target supporting plate and extending outwardly therefrom along the trailing edge adjacent opposing ends thereof, the remote ends of said hinge means being constructed and arranged to be joinable to a target throwing base arm; and said target supporting plate having joined thereto means for controllably varying the angles formed between horizontal plane passing through the pivots and the target supporting plate as the plate is moved relative to said pivots.

7. The arm assembly of claim 6 wherein said hinge means comprises rubber spacers bolted between said channel shaped rails.

8. The assembly of claim 7 wherein said means to vary said leading edge separation comprises linking the leading edges of said arms by a bolt and wing nut with a spring means biasing said edges apart, whereby movement of said nut on said bolt opens and closes the angle of the planes of said arms.

9. A target throwing arm assembly adapted to be attached to a conventional target throwing base, the assembly comprising:

an upstanding shaft;

a first target throwing arm mounted adjacent one end of said shaft, with its longitudinal axis projecting laterally of said the axis of said shaft, said arm defining a leading edge and a trailing edge to support a disk target;

power connection means joined to said lower target throwing arm, said means being constructed and arranged to be operably joinable to a power source of a target throwing base;

a second target throwing arm positioned generally above the first throwing arm and having a leading and trailing edge, hinge means for hingedly connecting the two arms, said trailing edge of one of said arms being hingedly mounted by said hinge means to the other of said arm along its trailing edge and at least two points adjacent opposite ends of said arms, said arms having target support portions, the hinge means permitting the angle formed by the plane of said target support portion of the second target throwing arm and a horizontal plane passing through the hinge means to be varied, and means to vary the angle whereby the vertical component of trajectory of at least one projectile may be varied.

10. The target throwing arm assembly of claim 9 wherein said hinge mounting comprises rubber spaces bolted between the trailing edges of said lower and second target throwing arms.

11. The target throwing arm assembly of claim 10 wherein said means to vary said leading edge separation comprises a threaded bolt passing through both arms near said leading edges, a spring formed over said bolt between said arms and a wing nut on said bolt to adjust the separation between said arms.

12. A trap for throwing targets comprising:

(a) a frame;

(b) an upstanding shaft supported for rotation upon said frame;

(c) a first target throwing arm mounted adjacent one end on said shaft, with its longitudinal axis projecting laterally of said shaft axis, said arm defining a leading and trailing edge, said trailing edge including an integrally formed channel shaped rail to support and guide disk targets;

(d) power means on said frame and operably joined to said first throwing arm to swing the arm and launch targets therefrom;

(e) a second target throwing arm with a leading and trailing edge, said trailing edge including an integrally formed channel shaped rail to support and guide disk targets;

(f) said first target throwing arm being hingedly attached to said second target throwing arm by means of compressible rubber spacers bolted between said channel shaped rails; and (g) means for varying the separation between said leading edges comprising linking the leading edges of said arms by a bolt and wing nut with a spring means biasing said edges apart, whereby movement of said nut on bolt opens and closes the angle of the planes of said arms.

* * * * *